United States Patent [19]

Geschka

[11] 4,350,028

[45] Sep. 21, 1982

[54] AUTOMATIC TOWEL DISPENSER

[75] Inventor: Hugo W. Geschka, Düsseldorf, Fed. Rep. of Germany

[73] Assignee: LUK Lamellen und Kupplungsbau GmbH, Bühl, Fed. Rep. of Germany

[21] Appl. No.: 206,622

[22] Filed: Nov. 13, 1980

Related U.S. Application Data

[63] Continuation of Ser. No. 50,641, Jun. 21, 1979, abandoned.

[30] Foreign Application Priority Data

Jun. 21, 1978 [DE] Fed. Rep. of Germany ..... 2827184

[51] Int. Cl.[3] ..... A47K 10/30

[52] U.S. Cl. ..... 68/13 R; 68/175

[58] Field of Search ..... 68/5 E, 9, 13 R, 15, 68/38, 175; 312/38; 38/2; 221/27-29; 226/115, 118, 127-133; 15/40

[56] References Cited

U.S. PATENT DOCUMENTS

| | | | |
|---|---|---|---|
| 796,345 | 8/1905 | Rovira | 68/9 |
| 2,295,955 | 9/1942 | LaPage | 68/13 R X |
| 2,969,664 | 1/1961 | Nasu et al. | 68/9 X |
| 3,128,206 | 4/1964 | Dungler | 68/5 E X |

FOREIGN PATENT DOCUMENTS

| | | | |
|---|---|---|---|
| 2602278 | 7/1977 | Fed. Rep. of Germany | 68/13 R |
| 400613 | 10/1933 | United Kingdom | 68/175 |

*Primary Examiner*—Philip R. Coe

*Attorney, Agent, or Firm*—Kontler, Grimes & Battersby

[57] ABSTRACT

In an automatic towel dispenser having a housing containing a washing and a drying chamber for an endless towel passable therethrough and having a cleaned section available for use extending outside the housing between a delivery slot and an inlet slot, respectively, formed in the housing, the endless towel being movable from the inlet slot to the washing chamber and from the drying chamber to the delivery slot, the housing also containing a first supply chamber for variably stacking a plurality of soiled towel sections of the endless towel therein, the first supply chamber being located between the inlet slot and the washing chamber, as viewed in travel direction of the towel, and the housing further containing a second supply chamber for variably stacking a plurality of cleaned towel sections of the endless towel therein, the second supply chamber being located between the drying chamber and the delivery slot, as viewed in travel direction of the towel, the soiled towel sections, after emptying of a given quantity of the cleaned towel sections, being passable through the washing and drying chambers, while washing and drying processes are set into operation, and being depositable in the second supply chamber for cleaned towel sections, the washing chamber having at least one wash tub and one rinsing tub through which the endless towel is passable in a looping manner, the improvement therein including a steam or vapor barrier located between the wash tub and the rinsing tub.

2 Claims, 2 Drawing Figures

AUTOMATIC TOWEL DISPENSER

Figure 1:
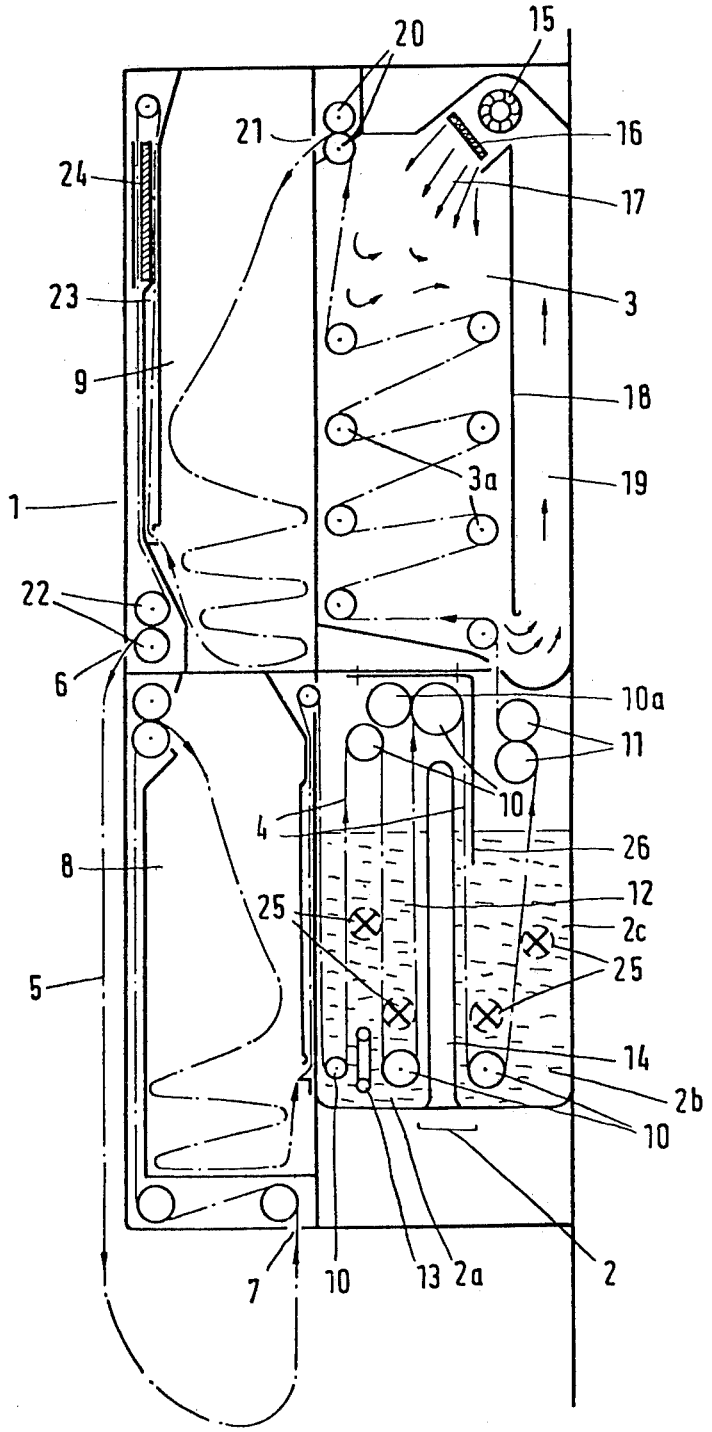

This is a continuation of application Ser. No. 50,641, filed June 21, 1979, and now abandoned.

The invention relates to an automatic towel dispenser having a housing containing a washing and a drying chamber for an endless towel passable therethrough and having a cleaned section available for use extending outside the housing between a delivery slot and an inlet slot, respectively, formed in the housing, the endless towel being movable from the inlet slot to the washing chamber and from the drying chamber to the delivery slot, the housing also containing a first supply chamber for variably stacking a plurality of soiled towel sections of the endless towel therein, the first supply chamber being located between the inlet slot and the washing chamber, as viewed in travel direction of the towel, and the housing further containing a second supply chamber for variably stacking a plurality of cleaned towel sections of the endless towel therein, the second supply chamber being located between the drying chamber and the delivery slot, as viewed in travel direction of the towel, the soiled towel sections being passable through the washing and drying chambers, while washing and drying processes are set into operation, and being depositable in the second supply chamber for cleaned towel sections, the washing chamber having at least one wash tub and one rinsing tub through which the endless towel is passable in a looping manner.

Such a towel dispenser has become known heretofore from German Published Non-Prosecuted Application DE-OS 26 02 278.

It is an object of the invention of the instant application to provide an automatic towel dispenser having an efficiency, and, especially, a drying efficiency, which is improved over that of heretofore known towel dispensers of this general type.

With the foregoing and other objects in view, there is provided, in accordance with the invention, in an automatic towel dispenser having a housing containing a washing and a drying chamber for an endless towel passable therethrough and having a cleaned section available for use extending outside the housing between a delivery slot and an inlet slot, respectively, formed in the housing, the endless towel being movable from the inlet slot to the washing chamber and from the drying chamber to the delivery slot, the housing also containing a first supply chamber for variably stacking a plurality of soiled towel sections of the endless towel therein, the first supply chamber being located between the inlet slot and the washing chamber, as viewed in travel direction of the towel, and the housing further containing a second supply chamber for variably stacking a plurality of cleaned towel sections of the endless towel therein, the second supply chamber being located between the drying chamber and the delivery slot, as viewed in travel direction of the towel, the soiled towel sections, after empyting of a given quantity of the cleaned towel sections, being passable through the washing and drying chambers, while washing and drying processes are set into operation, and being depositable in the second supply chamber for cleaned towel sections, the washing chamber having at least one wash tub and one rinsing tub through which the endless towel is passable in a looping manner, and improvement therein comprising a steam or vapor barrier located between the wash tub and the rinsing tub. Such a steam or vapor barrier prevents air with high moisture content from entering the drying chamber, which would otherwise considerably impair the efficiency of the drying device.

In accordance with another feature of the invention, the steam or vapor barrier comprises sealing means, such as sealing lips, for example, which are engageable with the towel.

In accordance with an alternate feature of the invention, the steam or vapor barrier comprises a covering located between the wash tub and the rinsing tub.

In accordance with a further feature of the invention, the covering overlaps or covers the upper region of the wash tub and is also immersed below the liquid level of the rinsing tub.

In accordance with a concomitant feature of the invention, especially if the rinsing liquid is cold, the covering is formed of a material having high thermal conductivity. This produces the advantageous effect of the steam or vapor being attracted by the cover and being condensed due to the temperature gradient, the resulting condensate further running off along the covering or dripping therefrom into the rinsing liquid.

Other features which are considered as characteristic for the invention are set forth in the appended claims.

The invention is not intended to be limited to the details shown, since various modifications and structural changes may be made therein without departing from the spirit of the invention and from the scope and range of equivalents of the claims.

Figure 2:
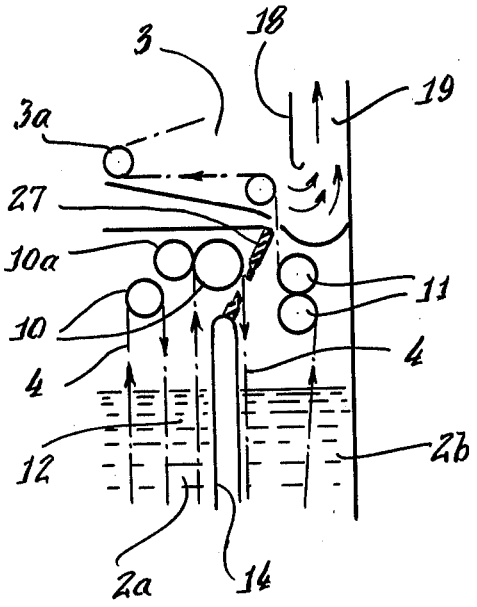

The construction and mode of operation of the dispenser, however, together with additional features and advantages thereof, will be best understood from the following description of specific embodiments when read in connection with the drawing wherein FIG. 1 is a diagrammatic view of an automatic towel dispenser embodying one form of the invention and FIG. 2 is a fragmentary diagrammatic view of a modified dispenser.

Referring now to FIG. 1 of the drawing, there is shown an automatic towel dispenser having a housing 1 with a washing chamber 2 and a drying chamber 3 provided therein. An endless towel 4, which is to be passed through the chambers 2 and 3, has cleaned towel sections 5 thereof, which are either ready or to be made ready for use, that extend between a delivery slot 6 and an inlet slot 7 on the outside of the housing 1. Between the inlet slot 7 and the washing chamber 2, as viewed in the direction of travel of the towel 4 represented by the various arrows shown thereon, a supply chamber 8 for the variable or alternating stacking of several used towel sections is provided. Between the drying chamber 3 and the delivery slot 6, a supply chamber 9 for the variable or alternating stacking of several clean towel sections is also provided. After the supply chamber 9 is sufficiently empty or the supply chamber 8 is sufficiently full, the towel dispenser is set into operation and a suitable number of soiled towel sections from the supply chamber 8 is initially passed through the washing and drying chambers 2 and 3 and then deposited in the supply chamber 9 for clean toweling.

The washing chamber 2 is made up of a wash tub **2*a* and a rinsing tub 2*b*, through which the towel 4 is conducted in the form of at least approximately vertical loops and over deflection rollers 10. At the outlet from the wash tub 2*a*, squeezing cylinders 10*a* are provided, and at the outlet from the rinsing tub 2*b*, squeezing cylinders 11. Heating rods 13 or the like are provided for heating the washing solution 12 in the wash tub 2*a***.

A partition 14 is disposed between the wash and rinsing tubs 2*a* and 2*b*, respectively.

After passing the squeezing cylinders 11, the towel 4 arrives in the drying chamber 3, wherein it is guided in looping form over deflection or reversing rollers 3*a*. A blower 15 with a heater 16 is provided in an upper region of the drying chamber 3, and blows drying air in the direction of the arrows 17 into the towel 4. Through an intake or induction shaft 19 separated by a partition 18 from the drying chamber 3, the drying air is sucked upwardly from below to the blower 15 and is there blown out again into the drying chamber 3. The drying air is thus displaced countercurrent to the travel of the towel 4. A pair of transport rollers 20 advances the dried towel 4 through an inlet slot 21 into the supply chamber 9, depositing the towel 4 therein in loop form. If fresh toweling is required, either, by pressing a suitable actuation switch, a pair of rollers 22 is set in motion for a given amount of rotation or by manually pulling down the towel section 5, fresh toweling is drawn out through the slot 6, whereby the fresh toweling located in the supply chamber 9 is taken from the lower layers thereof and drawn upwardly through an unfolding shaft 23 and, if desired or necessary, past an ironing device 24 and further on to the rollers 22 and out through the slot 6.

Both in the wash as well as in the rinsing tubs 2*a* and 2*b*, respectively, vane wheels 25 are provided on both sides of the towel 4 below the liquid level and are rotatable at high speed and thereby stir up the washing solution 12 as well as the rinsing liquid 2*c* and set the liquids and the towel 4 in motion, relative motion between the washing liquid 12 and rinsing liquid, respectively, and the towel 4 being producible thereby, which assures intensive cleaning of the towel 4 while simultaneously preserving it.

A covering 16 provided between the wash tub 2*a* and the rinsing tub 2*b* is fastened in the upper region of the washing compartment or chamber 2 and constitutes a steam or vapor seal between the two tubs 2*a* and 2*b*. The covering 26 overlaps or covers the wash tub 2*a*, extends into the rinsing tub 2*b* and dips into or is immersed in the rinsing liquid 2*c*. The rinsing liquid 2*c* is cold, at least colder than the washing liquid 12 in the tub 2*a*, so that a temperature gradient is formed between the steam of vapor produced above the wash tub 2*a* and the cover 26 formed of highly heat-conductive material, which causes the vapor or steam clouds to be attracted to and condensed on the covering 26. The condensate thus formed then dips or runs into the rinsing liquid 2*c*.

As mentioned hereinbefore, the invention is not limited to the embodiment shown, but rather, the steam or vapor barrier may also be in the form of a seal provided between the wash tub 2*a* and the rinsing tub 2*b*, such as a seal having rubber lips 27, for example, which engage the towel 4. This is shown in FIG. 2.

There are claimed:

1. In an automatic towel dispenser having a housing containing a washing and a drying chamber for an endless towel passable therethrough, a delivery slot and an inlet slot formed in the housing, the towel having a cleaned section available for use extending outside the housing between the delivery slot and the inlet slot, respectively, means defining a path from the inlet slot to the washing chamber and from the drying chamber to the delivery slot along which the endless towel is movable, the housing also containing a first supply chamber for variably stacking a plurality of soiled towel sections of the endless towel therein, the first supply chamber being located between the inlet slot and the washing chamber, as viewed in travel direction of the towel, and the housing further containing a second supply chamber for variably stacking a plurality of cleaned towel sections of the endless towel therein, the second supply chamber being located between the drying chamber and the delivery slot, as viewed in travel direction of the towel, the path extending through the washing and drying chambers and into the second supply chamber for cleaned towel sections, means for passing the soiled towel sections, after a given quantity of the cleaned towel sections have been emptied, through the washing and drying chambers, while washing and drying processes are set into operation, and for depositing the sections in the second supply chamber for cleaned towel sections, the washing chamber having, in common, at least one wash tub and one rinsing tub, the path extending through the wash tub and the rinsing tub, and means for passing the endless towel in a looping manner through the wash tub and the rinsing tub along the path therethrough, the improvement therein comprising a steam or vapor barrier located between the wash tub and the rinsing tub, said barrier comprising a covering formed of material having high thermal conductivity and being located in the common washing chamber between the wash tub and the rinsing tub, said covering overlapping an upper region of the wash tub and being immersed below rinsing liquid level in the rinsing tub.

2. In an automatic towel dispenser having a housing containing a washing and a drying chamber for an endless towel passable therethrough, a delivery slot and an inlet slot formed in the housing, the towel having a cleaned section available for use extending outside the housing between the delivery slot and the inlet slot, respectively, means defining a path from the inlet slot to the washing chamber and from the drying chamber to the delivery slot along which the endless towel is movable, the housing also containing a first supply chamber for variably stacking a plurality of soiled towel sections of the endless towel therein, the first supply chamber being located between the inlet slot and the washing chamber, as viewed in travel direction of the towel, and the housing further containing a second supply chamber for variably stacking a plurality of cleaned towel sections of the endless towel therein, the second supply chamber being located between the drying chamber and the delivery slot, as viewed in travel direction of the towel, the path extending through the washing and drying chambers and into the second supply chamber for cleaned towel sections, means for passing the soiled towel sections, after given quantity of the cleaned towel sections have been emptied, through the washing and drying chambers, while washing and drying processes are set into operation, and for depositing the sections in the second supply chamber for cleaned towel sections, the washing chamber having, in common, at least one wash tub and one rinsing tub, the path extending through the wash tub and the rinsing tub, and means for passing the endless towel in a looping manner through the wash tub and the rinsing tub along the path therethrough, the improvement therein comprising a steam or vapor barrier located between the wash tub and the rinsing tub, said barrier comprising sealing means engageable with the towel between the wash tub and the rinsing tub.

* * * * *

UNITED STATES PATENT AND TRADEMARK OFFICE

CERTIFICATE OF CORRECTION

PATENT NO. : 4,350,028

DATED : September 21, 1982

INVENTOR(S) : Hugo-Werner GESCHKA

It is certified that error appears in the above-identified patent and that said Letters Patent are hereby corrected as shown below:

Col. 3, line 37, "16" should read --26--.

Signed and Sealed this

Seventeenth Day of May 1983

[SEAL]

Attest:

DONALD J. QUIGG

Attesting Officer

Acting Commissioner of Patents and Trademarks